US007480475B2

(12) United States Patent
Miyoshi et al.

(10) Patent No.: US 7,480,475 B2
(45) Date of Patent: Jan. 20, 2009

(54) DEVELOPING DEVICE, AND IMAGE FORMING APPARATUS AND PROCESS CARTRIDGE USING THE DEVELOPING DEVICE

(75) Inventors: Yasuo Miyoshi, Yokohama (JP); Hajime Oyama, Ebina (JP); Katsuhiro Aoki, Yokohama (JP); Hiroshi Ikeguchi, Saitama (JP); Daichi Yamaguchi, Hino (JP)

(73) Assignee: Ricoh Company Limited, Tokyo (JP)

( * ) Notice: Subject to any disclaimer, the term of this patent is extended or adjusted under 35 U.S.C. 154(b) by 513 days.

(21) Appl. No.: 11/363,052

(22) Filed: Feb. 28, 2006

(65) Prior Publication Data

US 2006/0198663 A1 Sep. 7, 2006

(30) Foreign Application Priority Data

Mar. 3, 2005 (JP) ..... 2005-058582

(51) Int. Cl.
*G03G 15/08* (2006.01)

(52) U.S. Cl. ..... 399/252

(58) Field of Classification Search ..... 399/252, 399/279, 281, 283; 430/105, 110.1, 110.3
See application file for complete search history.

(56) References Cited

U.S. PATENT DOCUMENTS 5,339,141 A 8/1994 Suzuki et al.
5,424,814 A 6/1995 Suzuki et al.
5,450,177 A 9/1995 Oyama
5,565,973 A 10/1996 Fujishiro et al.
5,659,860 A 8/1997 Sasaki et al.
5,809,386 A * 9/1998 Iwata ..... 399/281
5,839,021 A * 11/1998 Hayashi et al. ..... 399/281 X
5,915,150 A * 6/1999 Kukimoto et al. ..... 399/252 X
6,026,265 A * 2/2000 Kinoshita et al. ..... 399/281
6,163,669 A 12/2000 Aoki et al.

(Continued)

FOREIGN PATENT DOCUMENTS

JP 63-138560 9/1988

(Continued)

OTHER PUBLICATIONS

U.S. Appl. No. 11/950,581, filed Dec. 5, 2007, Miyoshi.

(Continued)

*Primary Examiner*—Sandra L Brase
(74) *Attorney, Agent, or Firm*—Oblon, Spivak, McClelland, Maier & Neustadt, P.C.

(57) ABSTRACT

A developing device including a rotating developing roller bearing toner thereon, capable of developing an electrostatic latent image with the toner; a toner layer forming member configured to form a toner layer on the developing roller, and charge the toner of the toner layer at a nip between the developing roller and the toner layer forming member; and a toner supplying device configured to supply fresh toner to the developing device, wherein a charge quantity (q) of the toner on the developing roller varies according to the following equation $q(t)=A\cdot\{1-\exp(-t/t_g)\}$ wherein t represents a nip passing time of the toner on the developing roller, $t_g$ represents a time constant of charging the toner, and A represents a constant, and wherein the time constant $t_g$ is smaller than a rotation time of the developing roller per rotation;
and an image forming apparatus and a process cartridge using the developing device.

9 Claims, 4 Drawing Sheets

U.S. PATENT DOCUMENTS

| | | | | |
|---|---|---|---|---|
| 6,295,437 | B1 | 9/2001 | Hodoshima et al. | |
| 6,416,914 | B1 * | 7/2002 | Nakamura et al. | 430/110.1 X |
| 6,463,244 | B2 | 10/2002 | Aoki et al. | |
| 6,463,246 | B1 * | 10/2002 | Mizuno et al. | 399/279 X |
| 6,505,014 | B2 | 1/2003 | Aoki et al. | |
| 6,526,248 | B1 | 2/2003 | Aoki et al. | |
| 6,608,984 | B1 | 8/2003 | Matsumoto et al. | |
| 6,658,227 | B2 | 12/2003 | Oyama et al. | |
| 6,671,484 | B2 | 12/2003 | Miyoshi et al. | |
| 6,721,516 | B2 | 4/2004 | Aoki et al. | |
| 6,782,225 | B2 | 8/2004 | Kai et al. | |
| 6,901,233 | B2 | 5/2005 | Aoki et al. | |

FOREIGN PATENT DOCUMENTS

| | | |
|---|---|---|
| JP | 63-279284 | 11/1988 |
| JP | 10-063096 | 3/1998 |
| JP | 2000-105503 | 4/2000 |

OTHER PUBLICATIONS

U.S. Appl. No. 11/843,168, filed Aug. 22, 2007, Miyoshi.
U.S. Appl. No. 11/848,961, filed Aug. 31, 2007, Miyoshi.

* cited by examiner

DEVELOPING DEVICE, AND IMAGE FORMING APPARATUS AND PROCESS CARTRIDGE USING THE DEVELOPING DEVICE

BACKGROUND OF THE INVENTION

1. Field of the Invention

The present invention relates to a developing device for developing an electrostatic image. More particularly, the present invention relates to a developing device for use in electrophotographic image forming apparatus, such as copiers, facsimile machines and laser printers. In addition, the present invention also relates to an image forming apparatus and a process cartridge using the developing device.

2. Discussion of the Background

In image forming apparatus using electrophotography, an electrostatic latent image corresponding to image data is formed on an image bearing member such as photoreceptors, and then the electrostatic latent image is developed with a developing device to form a visible image. In the developing device, a toner negatively charged by a charging device is transported to a developing area, and then the toner is moved onto an electrostatic image formed on a photoreceptor due to the electric field formed between the photoreceptor and a developing roller. Every time the toner is consumed in the developing device, a fresh toner is supplied to the developing device from a toner container.

In order to visualize an electrostatic latent image with a toner, single component developing methods, in which a thin toner layer formed on a developer bearing member comes close to or contacts an image bearing member, have been broadly used conventionally. In a developing device used for such single component developing methods, a toner layer forming member contacts a developer bearing member upon application of pressure thereto so that a thin toner layer is formed on the developer bearing member. On the other hand, the toner is charged by being frictionized with the toner layer forming member. However, such electrostatic developing methods have a problem in which a toner tends to be insufficiently charged, and thereby non-charged toner particles are transported to a developing area.

In attempting to solve such a problem, published Japanese Utility Model Application No. 63-138560 discloses a developing device including a corona charger. The corona charger supplies monopolar ions to a toner layer formed on the surface of a developer bearing member immediately above therefrom. However, when a corona wire is contaminated, nonuniform electrostatic discharging occurs resulting in unstable charging of the toner particles. In addition, the toner particles cannot be charged uniformly because the corona charger supplies ions to the toner particles only from one side. When toner particles, remaining on the developer bearing member after developing, are transported to a charging area, the difference in charged level between the residual toner particles and supplied toner particles is so large that the toner layer cannot be charged uniformly.

Published unexamined Japanese Patent-Application No. (hereinafter referred to as JP-A) 10-63096 discloses a developing device including a charge-decreasing device and a charging device for toner particles. The charge-decreasing device utilizes alternating-current corona occuring between a developer bearing member and a layer forming blade made of a conductive or semiconductive material. It is described in JP-A 10-63096 that combination of the charge-decreasing device and the charging device arranged on a downstream side from the charge-decreasing device relative to a rotating direction of the developer bearing member, can solve a problem such that toner particles cannot be uniformly charged when toner particles remaining on the developer bearing member after developing are repeatedly transported to a charging area. However, the developing device including the above-mentioned two charging devices is large in size, i.e., a compact developing device cannot be provided.

SUMMARY OF THE INVENTION

Accordingly, an object of the present invention is to provide a developing device which can stably charge toner particles.

Another object of the present invention is to provide a process cartridge which has a long life.

Another object of the present invention is to provide an image forming apparatus which can produce high quality images for a long period of time.

These and other objects of the present invention, either individually or in combinations thereof, as hereinafter will become more readily apparent can be attained by a developing device for developing an electrostatic latent image formed on an image bearing member, comprising:

a rotating developing roller bearing toner thereon, capable of developing the electrostatic latent image with the toner;

a toner layer forming member configured to form a toner layer on the developing roller, and charge the toner of the toner layer at a nip between the developing roller and the toner layer forming member; and a toner supplying device configured to supply fresh toner to the developing device, wherein a charge quantity (q) of the toner on the developing roller varies according to the following equation:

$$q(t)=A\cdot\{1-\exp(-t/t_g)\} \quad (1)$$

wherein t represents a nip passing time of the toner on the developing roller, $t_g$ represents a time constant of charging the toner, and A represents a constant, and wherein the time constant $t_g$ is smaller than a rotation time of the developing roller per rotation.

In addition, the present invention provides an image forming apparatus and a process cartridge using above developing device.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

At first, the image forming apparatus of the present invention will be explained in detail.

Figure 1:
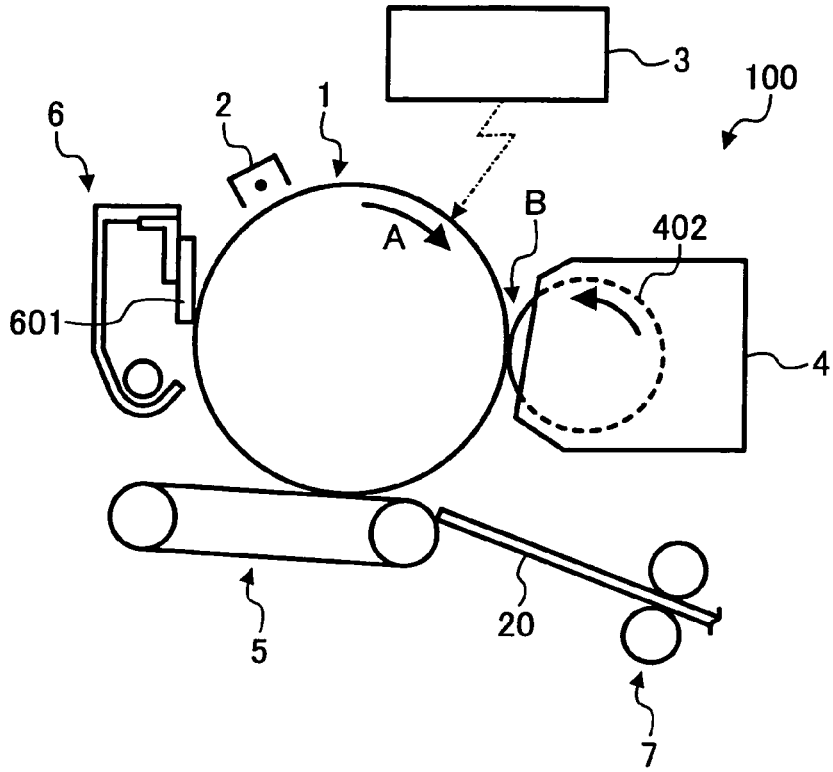
FIG. 1 is a schematic view illustrating an embodiment of the image forming apparatus of the present invention.

FIG. 1 is a schematic view illustrating an embodiment of the image forming apparatus of the present invention. An image forming apparatus 100 is illustrated in FIG. 1. Around a photoreceptor 1 serving as an image bearing member, a charging device 2 configured to uniformly charge the surface of the photoreceptor 1, a light irradiator 3 configured to irradiate the photoreceptor 1 with imagewise laser light, a developing device 4 configured to develop an electrostatic latent image formed on the photoreceptor 1 with a charged single component developer (hereinafter referred to as a toner) drawn up on a developing roller 402 to form a toner image, a transfer device 5 configured to transfer the toner image formed on the photoreceptor 1 onto a transfer paper 20, and a cleaning device 6 configured to remove a residual toner particles remained on the photoreceptor 1 are arranged in this order. A latent image forming device configured to form an electrostatic latent image on the photoreceptor 1 includes the charging device 2 and the light irradiator 3.

The image forming apparatus 100 also includes a paper feeding device (not shown) configured to feed a transfer paper from a paper feeding tray (not shown), and a fixing device (not shown) configured to fix the toner image transferred onto the transfer paper 20 in the transfer device 5. The surface of the photoreceptor 1, rotating in the direction indicated by a narrow A, is uniformly charged to have a predetermined potential (from 300 to 600 volts in absolute value) by the charging device 2, and then irradiated by imagewise laser light scanned in the axial direction thereof. Thus, an electrostatic latent image is formed on the photoreceptor 1. The electrostatic latent image formed on the photoreceptor 1 is developed in a developing area B at which the toner charged in the developing device 4 is adhered to the latent image, resulting in formation of a toner image.

On the other hand, the transfer paper 20 is fed from the paper feeding device, and then is timely fed to a transfer area in which the photoreceptor 1 faces the transfer device 5. The transfer device 5 applies a charge, having an opposite polarity to that of the toner image on the photoreceptor 1, to the transfer paper 20 so that the toner image formed on the photoreceptor 1 is transferred onto the transfer paper 20. Then the transfer paper 20 is separated from the photoreceptor 1 and fed to the fixing device. The toner image is fixed to the transfer paper 20 in the fixing device, and the transfer paper having an image thereon is discharged. After the toner image is transferred in the transfer device 5, the residual toner remaining on the photoreceptor 1 is removed with a cleaning blade 601 in the cleaning device 6.

The image forming apparatus 100 illustrated in FIG. 1 is an image forming apparatus in which a toner image formed on a photoreceptor is directly transferred onto a transfer paper. In the present invention, an image forming apparatus such that a toner image formed on a photoreceptor is once transferred onto an intermediate transfer medium and then the toner image on the intermediate transfer medium is transferred onto a transfer paper can also be used. For example, an image forming apparatus which forms images by the following method can also be used:

(1) different color toner images are formed on a photoreceptor one by one;

(2) the color toner images formed on the photoreceptor are transferred so as to be superimposed on an intermediate transfer belt serving as an intermediate transfer medium with a primary transfer device; and (3) the color toner image formed on the intermediate transfer belt is transferred onto a transfer paper with a secondary transfer device.

In addition, a tandem type image forming apparatus can be used in the present invention. In the tandem type image forming apparatus, plural image forming units each including a photoreceptor are arranged in line along an intermediate transfer belt serving as an intermediate transfer member. Different color toner images are formed on the respective photoreceptors included in the image forming units. The different toner images are transferred onto the intermediate transfer belt with a primary transfer device so that the toner images are superimposed on the intermediate transfer belt. The thus superimposed toner images are then transferred onto a transfer paper with a secondary transfer device, resulting in formation of a color image on the transfer paper.

Figure 2:
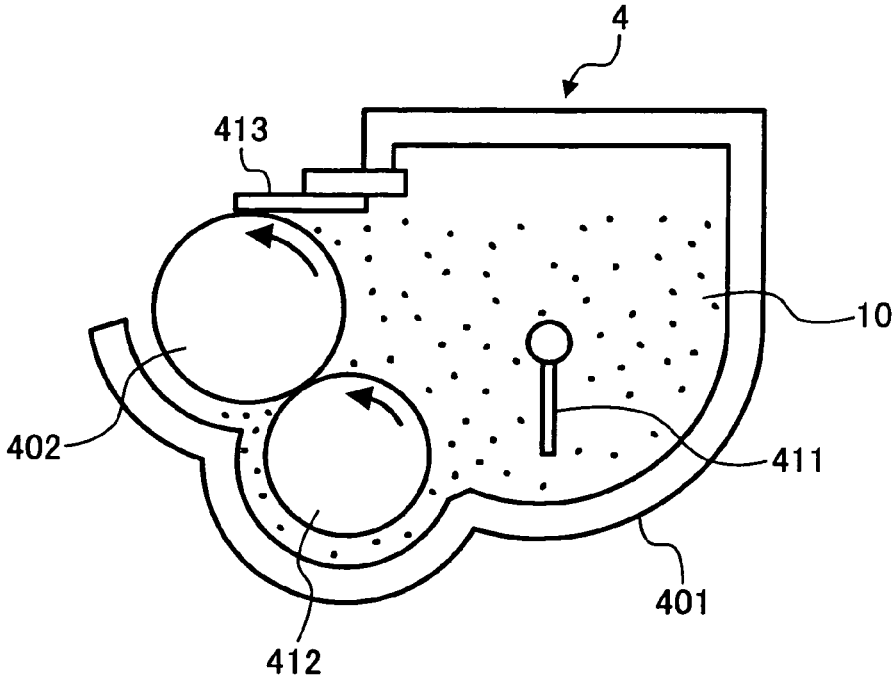
FIG. 2 is a schematic view illustrating an embodiment of the developing device of the present invention.

FIG. 2 is a schematic view illustrating an embodiment of the developing device 4 of the present invention. The developing device 4 uses a single component developing method. A toner (i.e., a single component developer) layer is formed on a developing roller 402 serving as a toner bearing member, and then the toner layer is transported by the rotated developing roller 402 so as to contact the photoreceptor 1, resulting in development of an electrostatic latent image formed on the photoreceptor 1. A toner 10, contained in a housing 401 connected to a hopper, is agitated by rotation of an agitator 411 serving as an agitation device, and then mechanically fed to a feeding roller 412 serving as a toner feeding member. The feeding roller 412 is made of a urethane foam etc., and has flexibility. The surface of the feeding roller 412 has cells having a diameter of from 50 to 500 μm, and thereby the toner can be easily held. The feeding roller 412 has a relatively low hardness (JIS-A) of from 10 to 30° so as to be uniformly contacted the developing roller 402.

The toner 10, fed from the feeding roller 412 and drawn up on the developing roller 402, forms a uniform thin layer and is charged by passing through a doctor blade 413 serving as a toner layer forming member. The doctor blade 413, having a platy form or a cylindrical form, contacts the developing roller 402 bearing the toner, and forms a uniform thin toner layer on the developing roller 402. The doctor blade 413 has a tip portion free from a holder of the blade, wherein the tip portion preferably has a length of from 10 to 15 mm. When the length of the tip portion is too large, the developing device 4 is upsized, i.e., a compact image forming apparatus is not provided. When the length is too small, the doctor blade 413 tends to vibrate when contacting the developing roller 402, resulting in production of abnormal images such as unevenness in a lateral direction. The doctor blade 413 preferably contacts the developing roller 402 with a pressure of from 0.049 to 2.45 N/cm (i.e., from 5 to 250 gf/cm). When the pressure is too large, the amount of toner drawn up on the developing roller 402 is too small and the charge quantity of the toner is too large, resulting in deterioration of the image density. When the pressure is too small, a thin layer cannot be uniformly formed and a block of the toner tends to pass through the doctor blade 413, resulting in deterioration of the image quality. In this example of the present invention, the developing roller 402 has a JIS-A hardness of 30°, the doctor blade 413 is a SUS plate having a thickness of 0.1 mm, and the doctor blade 413 contacts the developing roller 402 with a pressure of 60 gf/cm.

The doctor blade 413 preferably contacts the developing roller 402 so as to trail the photoreceptor (i.e., so as to face in the direction of rotation of the developing roller 402) wherein the angle formed between the doctor blade 413 and the tangent line of the developing roller 402 is from 10 to 45°. Toner particles scraped off with the doctor blade 413 and existing between the doctor blade 413 and the developing roller 402, are removed from the developing roller 402. Therefore, a uniform thin layer having a thickness per unit area of from 0.4 to 0.8 mg/cm$^2$ can be formed. In this example of the present invention, the toner has a charge quantity of from −10 to −30 μC/g, and develops a latent image formed on the photoreceptor 1.

Figure 3:
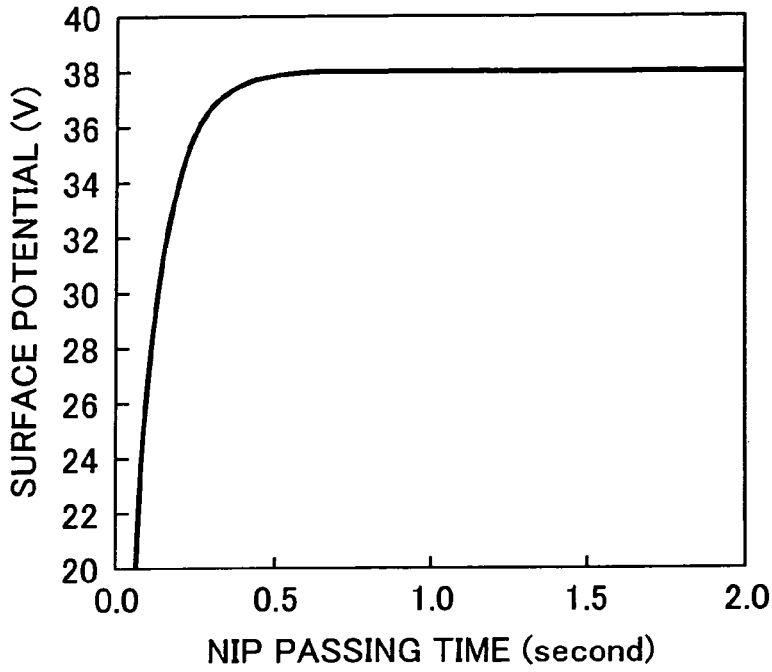
FIG. 3 is a graph illustrating the relationship between the nip passing time and the surface potential of the toner.

When a toner layer has an appropriate thickness, the toner can be charged by passing through a nip formed between the developing roller 402 and the doctor blade 413. The charge quantity of the toner increases as the nip width of the doctor blade 413 increases, but is saturated at a certain point. FIG. 3 is a graph illustrating the relationship between the nip passing time and the surface potential of the toner layer. The nip passing time represents a time in that the toner layer contacts the doctor blade 413. The surface potential can be measured by a surface potential electrometer.

The surface potential of the toner layer formed on the developing roller 402 equals the integral of the potential of charges of the toner particles of the toner layer. When the mass (m) of the toner layer is constant, the surface potential of the toner layer changes depending on the charge quantity of the toner particles of the toner layer. Therefore, the charge quantity of the toner (q) exponentially increases when the nip passing time of the toner increases. In particular, the following relationship is satisfied:

$$q(t)=A\cdot\{1-\exp(-t/t_g)\} \quad (1)$$

wherein t represents the nip passing time of the toner, $t_g$ represents a time constant of charging the toner, and A represents a constant.

When the time constant $t_g$ is large, the toner cannot be uniformly charged. It is because when the time constant $t_g$ is large, it takes a long time for the toner to be sufficiently charged, i.e., each of the toner particles has to pass through the nip many times in order to be sufficiently charged. Therefore, the charge quantity of each of the toner particles varies depending on the number of times at which the toner passes through the nip. If the toner is sufficiently charged by passing through the nip only once, the charge quantity of each of the toner particles does not varies, resulting in production of high quality images.

Typically, every time the toner is consumed in the developing device, a fresh toner is supplied from a toner container. However, after long repeated use of the developing device, non-charged toner particles and insufficiently charged toner particles are produced. In particular, when the time constant $t_g$ after long repeated use is larger than initial $t_g$, a large amount of non-charged toner particles are produced. It is because charge exchange occurs between the supplied toner and the toner remaining in the developing device, due to the difference in the charging level. When the difference in the charging level is large, charge exchange occurs vigorously, thereby non-charged toner particles and positively charged toner particles are produced. Therefore, to prevent production of non-charged toner particles and positively charged toner particles, the time constant $t_g$ is preferably stabilized even after long repeated use. When the time constant $t_g$ is stabilized, abnormal images such as background fouling are not produced, and high quality images can be produced for a long period.

The developing device of the present invention can optionally include a toner removing device. By once removing the toner 10 remaining on the developing roller 402, each toner particle tends to pass through the nip formed between the doctor blade 413 and the developing roller 402 same times. Therefore, $t_g$ does not decrease, resulting in stable development of the developing device 4. Preferably, not less than 80% of the remaining toner is removed. In the developing device 4 illustrated in FIG. 2, the feeding roller 412 also serves as a toner removing device. Specifically, the rotation direction of the feeding roller 412 is preferably the same as that of the developing roller 402. It is because the feeding roller can scratch off the toner remaining on the developing roller 402 at an entrance of the nip, while supplying a toner at an exit of the nip. Thereby, 90% of the remaining toner can be removed. Conventionally, only 50% of the remaining toner is removed.

Figure 4:
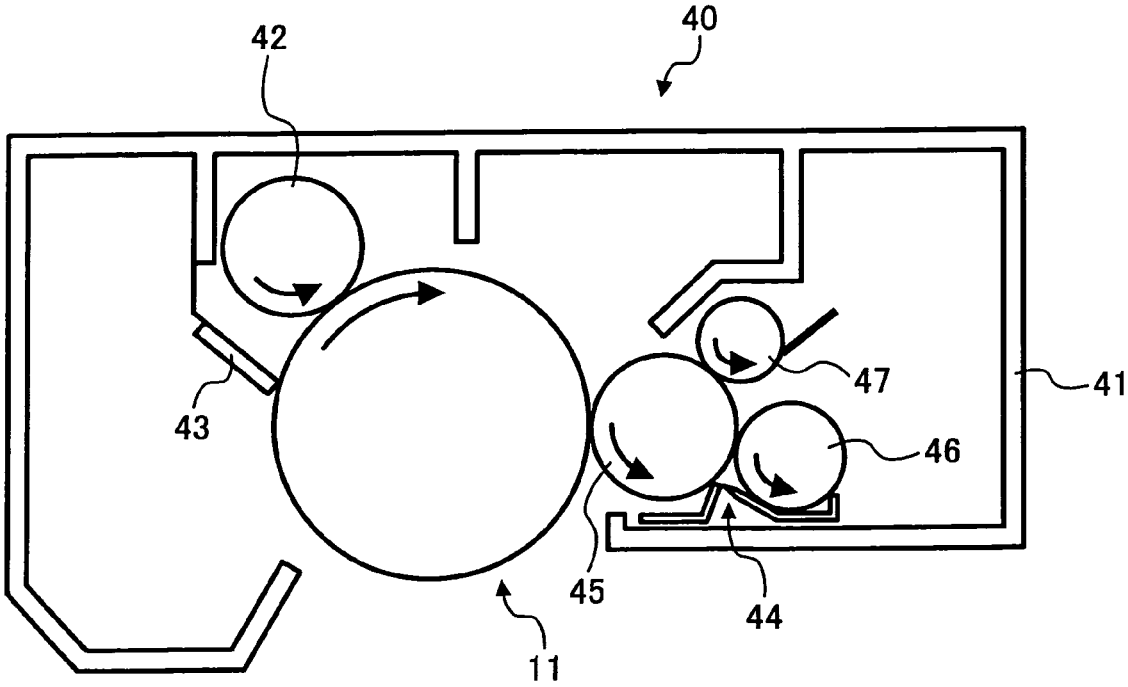
FIG. 4 is a schematic view illustrating an embodiment of the process cartridge of the present invention.

The developing device of the present invention can be included in a process cartridge. FIG. 4 is a schematic view illustrating an embodiment of the process cartridge of the present invention. A process cartridge 40 includes a photoreceptor 11, a casing 41, a charging device 42, a cleaning device 43 and a developing device 44 of the present invention. The developing device 44 includes a developing roller 45, a feeding roller 46 and a toner layer forming member 47. The feeding roller 46 also serves as a toner removing device. The process cartridge 40 is attachable to and detachable from an image forming apparatus. By using such a process cartridge, image forming components such as a developing roller and a toner layer forming member can be easily replaced, and therefore high quality images can be stably produced.

In addition, the life of the developer can be lengthened by using such a process cartridge. Therefore, replacement frequency of the plural process cartridge is low, resulting in good maintainability. Moreover, because process cartridge can be used for various types of machines while recycled, total manufacturing cost of the machines can be reduced by using such a process cartridge.

Next, the photoreceptor 1 for use in the present invention will be explained in detail. The photoreceptor 1 may be a single-layered photoreceptor in which a solvent dissolving or dispersing a charge generation material, a charge transport material and a binder resin is coated on a substrate, or a multi-layered photoreceptor including a charge generation layer and a charge transport layer on a substrate. The photoreceptor 1 can optionally include an undercoat layer between the substrate and the photosensitive layer, or a protective layer on the photosensitive layer.

The photosensitive layer of the single-layered photoreceptor is prepared by coating a coating liquid, which is prepared by dissolving or dispersing an inorganic photoconductive powder such as CdS, CdSe, Se, and dye sensitized ZnO; an organic pigment such as phthalocyanine, azo pigments, indigo pigments and perylene pigments; a charge transport material such as polyvinylcarbazole, derivatives of oxazole, derivatives of triphenylamine, pyrazoline, phenylhydrazone and derivatives of α-stilbene; and a binder resin, in a solvent.

The charge generation layer of the multi-layered photoreceptor may include only a charge generation material, or optionally together with a binder resin. The charge generation layer is prepared by coating a coating liquid, which is prepared by dissolving or dispersing the charge generation material and the other materials in a solvent, on an undercoat layer, followed by drying.

Specific examples of the charge generation materials include organic materials such as C.I. Pigment Blue 25 (C.I. 21180), C.I. Pigment Red 41 (C.I. 21200), C.I. Acid Red 52 (C.I. 45100), C.I. Basic Red 3 (C.I. 45210), phthalocyanine pigments having porphyrin skeleton, azo pigments having carbazole skeleton (disclosed in JP-A 53-95033), azo pigments having stilbene skeleton (disclosed in JP-A 53-138229), azo pigments having distyrylbenzene skeleton (disclosed in JP-A 53-133455), azo pigments having triphenylamine skeleton (disclosed in JP-A 53-132547), azo pigments having dibenzothiophene skeleton (disclosed in JP-A 54-21728), azo pigments having oxadiazole skeleton (disclosed in JP-A54-12742), azo pigments having fluorenone skeleton (disclosed in JP-A 54-22834), azo pigments having bisstilbene skeleton (disclosed in JP-A 54-17733), azo pigments having distyryloxadiazole skeleton (disclosed in JP-A 54-2129), azo pigments having distyrylcarbazole skeleton (disclosed in JP-A 54-17734), tris-azo pigments having carbazole skeleton (disclosed in JP-As 57-195767 and 57-195758), phthalocyanine pigments such as C.I. Pigment Blue 16 (C.I. 74100), indigo pigments such as C.I. Vat Brown 5 (C.I. 73410) and C.I. Vat Dye (C.I. 73030), perylene pigments such as ARGO SCARLET B (manufactured by Violet Corp.) and INDANTHRENE SCARLET R (manufactured by Bayer AG); and inorganic pigments such as Se, Se alloy, CdS, and amorphous Si.

Specific examples of the binder resins for use in the charge generation layer include polyamide, polyurethane, polyester, epoxy resins, polyketone, polycarbonate, silicone resins, acryl resins, polyvinyl butyral, polyvinyl formal, polyvinyl ketone, polystyrene, poly-N-vinylcarbazole, polyacrylamide, etc.

The content of the binder resin in the charge generation layer is preferably from 5 to 100 parts by weight, and more preferably from 10 to 50 parts by weight, per 100 parts by weight of the charge generation material included in the layer.

Specific examples of the solvents for use in the charge generation layer coating liquid include tetrahydrofuran, cyclohexanone, dioxane, dichloroethane, cyclohexane, methyl ethyl ketone, 1,1,2-trichloroethane, 1,1,2,2-tetrachloroethane, dichloromethane, ethyl cellosolve, and the like. These solvents can be used alone or in combination.

The charge generation layer preferably has a thickness of from 0.01 to 2 μm, and more preferably from 0.1 to 1 μm.

The charge transport layer is prepared by coating a coating liquid, which is prepared by dissolving or dispersing a charge transport material and a binder resin in a solvent optionally together with a plasticizer and a leveling agent, on the charge generation layer, followed by drying.

Specific examples of the charge transport materials include electron donating materials such as poly-N-vinyl carbazole and its derivatives, poly-γ-carbazolylethylglutamate and its derivatives, pyrene-formaldehyde condensation products and their derivatives, polyvinyl pyrene, polyvinyl phenanthrene, oxazole derivatives, oxadiazole derivatives, imidazole derivatives, triphenylamine derivatives, 9-(p-diethylaminostyryl)anthracene, 1,1-bis(4-dibenzylaminophenyl)propane, styrylanthracene, styrylpyrazoline, phenylhydrazone, α-stilbene derivatives, and the like.

Specific examples of the binder resin for use in the charge transport layer include known thermoplastic resins and thermosetting resins, such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyacrylate resins, phenoxy resins, polycarbonate, cellulose acetate resins, ethyl cellulose resins, polyvinyl butyral, polyvinyl formal, polyvinyl toluene, poly-N-vinyl carbazole, acrylic resins, silicone resins, epoxy resins, melamine resins, urethane resins, phenolic resins, alkyd resins and the like.

Specific examples of the solvents for use in the charge transport layer coating liquid include tetrahydrofuran, dioxane, toluene, monochlorobenzene, 1,2-dichloroethane, cyclohexanone, methylene chloride, 1,1,2-trichloroethane, 1,1,2,2-tetrachloroethane, and the like. These solvents can be used alone or in combination.

The charge transport layer preferably has a thickness of from 10 to 100 μm, and more preferably from 20 to 40 μm.

Suitable resins for use in the undercoat layer include thermoplastic resins such as polyamide, polyvinyl alcohol, polyvinyl acetal, polyvinyl butyral, polyvinyl methyl ether, polyvinyl pyrrolidone, poly-N-imidazole, ethyl cellulose, nitrocellulose, ethylene-acrylic acid copolymer, casein and gelatin; and thermosetting resins such as phenol resin, urea resin, melamine resin, aniline resin, alkyd resin, unsaturated polyester and epoxy resin. The undercoat layer can include fine powder pigments of metal oxides such as titanium oxide, zirconium oxide, indium oxide, antimony oxide, tin oxide, etc.

Specific examples of the solvents for use in the undercoat layer coating liquid include cyclohexane, benzene, toluene, xylene, dichloromethane, 1,1-dichloroethane, 1,2-dichloroethane, 1,1,2-trichloroethane, 1,1,2,2-tetrachloroethane, monochlorobenzene, methanol, ethanol, butanol, methyl ethyl ketone, methyl isobutyl ketone, methyl-n-amyl ketone, methyl-n-butyl ketone, diethyl ketone, methyl-n-propyl ketone, cyclohexanone, methyl cellosolve, ethyl cellosolve, butylcellosolve, ethyl acetate, butyl acetate, dioxane, tetrahydrofuran, and the like.

The undercoat layer preferably has a thickness of from 0.1 to 10 μm, and more preferably from 0.3 to 5 μm.

In the photoreceptor for use in the present invention, the protective layer is optionally formed on the charge transport layer.

The protective layer includes a binder resin and a fine power of metals or metal oxides. It is preferable that the binder resin included in the protective layer is transparent to visible light and infrared light, and has good electric insulation, mechanical strength and adhesion properties. Suitable resins for use in the protective layer include polyester resins, polycarbonate resins, polyurethane resins, epoxy resins, acryl resins, vinyl chloride-vinyl acetate copolymers, silicone resins, alkyd resins, melamine resins, phenol resins, polyvinylchloride resins, cyclized butadiene rubbers, fluorocarbon resins, etc. Specific examples of the fine powders of metals include gold, silver, aluminum, iron, copper, nickel, etc. Specific examples of the fine powders of metal oxides include zinc oxide, titanium oxide, tin oxide, bismuth oxide, antimony oxide, indium oxide, etc.

The content of the fine powders of metals or metal oxides is preferably from 5 to 500 parts by weight, per 100 parts by weight of the binder resin included in the layer.

The protective layer preferably has a thickness of from 0.5 to 30 μm.

Next, the toner 10 for use in the present invention will be explained in detail.

The toner for use in the present invention has a volume average particle diameter of from 4 to 10 μm. Such a toner can produce high quality images having a resolution of not less than 1200 dpi. In addition, the toner includes an external additive having a volume average particle diameter of from 50 to 150 nm. When a volume average particle diameter of the external additive is too small, the external additive tends to be embedded in a toner binder resin. In contrast, when a volume average particle diameter of the external additive is too large, the external additive tends to get caught in the gap between the developing roller and the control member, therefore a uniform toner layer cannot be formed, resulting in producing abnormal images such as white line.

The toner 10 may be negatively charged or positively charged depending on the polarity of the photoreceptor.

The toner for use in the present invention will be explained in detail below.

<Average Circularity>

The toner for use in the present invention preferably has an average circularity of from 0.96 to 1.00. The circularity of a particle is determined by the following equation:

$$C=Lo/L$$

wherein C represents the circularity, Lo represents the length of the circumference of a circle having the same area as that of the image of the particle and L represents the peripheral length of the image of the particle. The circularity indicates the irregularity of the toner particle. When the toner is completely spherical, C is 1.00. When the toner shape becomes more complex, the circularity decreases.

When the average circularity is less than 0.95, transfer efficiency of the resultant toner cannot be improved and high quality images cannot be produced. When the toner has the average circularity of from 0.960 to 0.998, high definition images can be produced.

The shape of a particle is preferably determined by an optical detection method such that an image of the particle is optically detected by a CCD camera and analyzed. A particle suspension is allowed to get through the image pickup detector located on the flat plate so as to be detected.

The average circularity of the toner can be determined by a flow-type particle image analyzer, FPIA-2000 manufactured by Sysmex Corp.

Specifically, the method is as follows:

(1) 0.1 g to 0.5 g of a sample to be measured is mixed with 100 ml to 150 ml of water from which solid impurities have been removed and which includes 0.1 ml to 0.5 ml of a dispersant (i.e., a surfactant) such as an alkylbenzene sulfonic acid salt;

(2) the mixture is dispersed using an ultrasonic dispersing machine for about 1 to 3 minutes to prepare a suspension including particles of 3,000 to 10,000 per micro-liter of the suspension; and (3) the average circularity and circularity distribution of the sample in the suspension are determined by the measuring instrument mentioned above.

<Toner Manufacturing Method>

The toner having an average circularity of from 0.96 to 1.00 is manufactured by wet granulation methods such as suspension polymerization method, emulsion aggregation method, dispersion polymerization method, interfacial polymerization method, dissolution suspension method and phase-inversion emulsification method. A spherical toner can be also prepared by heating a toner manufactured by dry pulverization method, however, this method needs much more energy. Among above-mentioned wet granulation methods, suspension polymerization method and dispersion polymerization method are preferably used because these methods can stably manufacture a spherical toner having narrow particle diameter distribution and good chargability. Dissolution suspension method is also preferably used because this method can use polyester resin having an advantage over low-temperature fixability.

Suspension Polymerization Method

In suspension polymerization method, a spherical toner is prepared as follows:

(1) mixing a monomer (after-mentioned), a dispersion stabilizer and a colorant using a ball mill optionally together with a crosslinking agent, a charge controlling agent, a release agent, etc.;

(2) adding a polymerization initiator thereto to prepare a monomer constituent mixture;

(3) dispersing the monomer constituent mixture into an aqueous medium including a dispersion stabilizer, and agitating using a homogenizer to prepare a suspension liquid;

(4) heating the suspension liquid until polymerization reaction is finished to prepare a colored particulate polymer, after the nitrogen substitution; and (5) washing and drying the colored particulate polymer to prepare a toner.

Specific examples of the monomers include monomers having a vinyl group such as styrenes (o-methylstyrene, m-methylstyrene, p-methylstyrene, 2,4-dimethylstyrene, butylstyrene, octylstyrene, etc.) and derivatives of the styrenes. Among these, styrene monomers can be preferably used. Specific examples of another vinyl monomers include ethylene-type unsaturated mono-olefins such as propylene, butylenes and isobutylene; halogenated vinyl compounds such as vinyl chloride, vinylidene chloride, vinyl bromide and vinyl fluoride; vinyl esters such as vinyl acetate, vinyl propionate, vinyl benzoate and vinyl butyrate; α-methyl fatty acid mono-caboxylate such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, phenyl acrylate, methyl α-chloroacrylate, methyl methacrylate, ethyl methacrylate, propyl methacrylate, n-butyl methacrylate, isopropyl methacrylate, n-octyl methacrylate, dodecyl methacrylate, 2-ethylhexyl methacrylate, stearyl methacrylate, phenyl methacrylate and diethylaminoethyl methacrylate; derivatives of acrylic acid or methacrylic acid such as acrylonitrile, methacrylonitrile and acrylamide; vinyl ethers such as vinyl methyl ether and vinyl isobutyl ether; vinyl ketones such as vinyl methyl ketone, vinyl hexyl ketone and methyl isopropenyl ketone; N-vinyl compounds such as N-vinylpyrrole, N-vinylcarbazole, N-vinylindole and N-vinylpyrrolidone; and vinylnaphthalene. These can be used alone or in combination.

In suspension polymerization method, the monomer constituent mixture can include a crosslinking agent to produce a crosslinking product. Specific examples of the crosslinking agents include divinylbenzene, divinylnapthtalene, polyethylene glycol diacrylate, diethylene glycol diacrylate, triethylene glycol diacrylate, 1,3-butylene glycol diacrylate, 1,6-hexane glycol dimethacrylate, neopentyl glycol diacrylate, dipropylene glycol dimethacrylate, polypropylene glycol dimethacrylate, 2,2'-bis(4-methacryloxydiethoxyphenyl) propane, 2,2'-bis(4-acryloxydiethoxyphenyl)propane, trimethylolpropane trimethacrylate, trimethylolmethane tetraacrylate, dibromneopentyl glycol dimethacrylate, diallyl phthalate, etc. The content of the crosslinking agent is preferably from 0.001 to 15 parts by weight, and more preferably from 0.1 to 10 parts by weight, per 100 parts by weight of the monomer. When the content is too high, the resultant toner cannot be melt by application of heat, resulting in deterioration of fixability. When the content is too low, toner blocking resistance and durability of the resultant toner deteriorates. In addition, the resultant toner tends to cause the cold offset problem in that toner particles which are not sufficiently fixed to the paper adheres to the fixing roller and transferred onto the next paper.

Suitable dispersion stabilizers for use in suspension polymerization method include water-soluble polymers such as polyvinyl alcohol, starch, methyl cellulose, carboxymethyl cellulose, hydroxymethyl cellulose, sodium polyacrylate and sodium polymethacrylate; barium sulfate, calcium sulfate, barium carbonate, magnesium carbonate, calcium phosphate, talc, clay, diatomite and fine powder of metal oxide etc. The aqueous medium preferably includes the dispersion stabilizer from 0.1 to 10% by weight.

In suspension polymerization method, the polymerization initiator may be added to the suspension liquid (i.e., after dispersing the monomer constituent mixture into the aqueous medium). However, it is preferable that the polymerization initiator may be added to the monomer constituent mixture (i.e., before dispersing the monomer constituent mixture into the aqueous medium), in order that each of the suspension particles uniformly contains the polymerization initiator. Specific examples of the polymerization initiators include azo or diazo initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisbutyronitrile; and peroxide initiators such as benzoyl peroxide, methyl ethyl ketone peroxide, isopropyl peroxide, 2,4-dichlorylbenzoyl peroxide and lauryl peroxide.

In suspension polymerization method, a magnetic toner can be manufactured by adding a magnetic material to the monomer constituent mixture. Specific examples of the magnetic materials include fine powders of ferromagnetic metals such as iron, cobalt, and nickel; and fine powders of alloys or metal compounds such as magnetite, hematite and ferrite. The magnetic material preferably has a particle diameter of from 0.05 to 5 μm, and more preferably from 0.1 to 1 μm. When the resultant toner has a small particle diameter, the magnetic material preferably has a particle diameter of not greater than 0.8 μm. The content of the magnetic material included in the monomer constituent mixture is preferably from 10 to 60 parts by weight per 100 parts by weight of the monomer constituent mixture. The surface of the magnetic material can be treated with surface treatment agents such as silane coupling agent and titanium coupling agent, or reactive resins. Typically, the content of the surface treatment agent is preferably not greater than 5 parts by weight, and more preferably from 0.1 to 3 parts by weight, per 100 parts by weight of the magnetic material. However, it depends on the surface area or the density of hydroxyl group exiting on the surface of the magnetic material. Such a magnetic material has good dispersibility in the monomer, and do not effect on any other toner properties.

Dispersion Polymerization Method

In dispersion polymerization method, a spherical particulate polymer is prepared as follows:

(1) dissolving a polymeric dispersant in a hydrophilic organic liquid; and (2) adding a vinyl monomer (or plural vinyl monomers), which is soluble in the hydrophilic organic liquid but a resultant polymer is insoluble or swelled in the hydrophilic organic liquid, thereto; and (3) subjecting to a polymerization.

In particular, a particulate polymer, having smaller particle diameter and narrower particle diameter distribution than these of the target toner, can be used as a seed in the dispersion polymerization. A monomer for use in growing the seed (hereinafter referred to as seed-growth reaction) may be same or different monomer for use in manufacturing the seed (hereinafter referred to as seed-manufacture reaction), provided that the resultant polymer is insoluble in the hydrophilic organic liquid.

The hydrophilic organic liquid dilutes monomers for use in the seed-manufacture reaction or the seed-growth reaction. Specific examples of the hydrophilic organic liquids include alcohols such as methyl alcohol, ethyl alcohol, modified ethyl alcohol, isopropyl alcohol, n-butyl alcohol, isobutyl alcohol, t-butyl alcohol, s-butyl alcohol, t-amyl alcohol, 3-pentanol, octyl alcohol, benzyl alcohol, cyclohexanol, furfuryl alcohol, tetrahydrofurfuryl alcohol, ethylene glycol, glycerin and diethylene glycol; and ether alcohols such as methyl cellosolve, cellosolve, isopropyl cellosolve, butyl cellosolve, ethylene glycol monomethyl ether and ethylene glycol monoethyl ether.

These can be used alone or in combination. When above-mentioned alcohols and ether alcohols, and other organic liquids (except alcohols and ether alcohols) are used in combination, SP (solubility parameter) value of the organic liquid can be controlled, provided that the resultant polymer is insoluble in the organic liquid. By controlling SP value, the particle diameter of the resultant particulate polymer can be controlled, and adherence between each of the seed particles and production of new seed particles can be prevented. Suitable organic liquids for use in combination with above-mentioned alcohols and ether alcohols include hydrocarbons such as hexane, octane, petroleum ether, cyclohexane, benzene, toluene and xylene; halogenated hydrocarbons such as carbon tetrachloride, trichloroethylene and tetrabromoethane; ethers such as ethyl ether, dimethyl glycol, dioxane and tetrahydrofuran; acetals such as methylal and diethyl acetal; ketones such as acetone, methyl ethyl ketone and methyl isobutyl ketone; esters such as butyl formate, butyl acetate, ethyl propionate and cellosolve acetate; acids such as formic acid, acetic acid and propionic acid; sulfur or nitrogen containing organic compounds such as nitropropene, nitrobenzene, dimethylamine, monoethanolamine, pyridine, dimethyl sulfoxide and dimethyl formamide; and water.

By changing the combination and the mixing ratio of the organic liquid mixture at each stage of the polymerization reaction (i.e., the beginning, the middle and the end of the polymerization reaction), average particle diameter, particle diameter distribution and drying condition of the resultant particulate polymer can be controlled.

Specific examples of the polymeric dispersants include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine) In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); cellulose compounds such as methyl cellulose, hydroxyethyl cellulose and hydroxypropyl cellulose; and copolymers prepared using monomers such as above-mentioned hydrophilic monomers, and compounds having a benzene ring and its derivatives (e.g., styrene, α-methyl styrene and vinyl toluene), derivatives of acrylic acid and methacrylic acid (e.g., acrylonitrile, methacrylonitrile and acrylamide), or cross-linking monomers (e.g., ethylene glycol dimethacrylate, diethylene glycol dimethacrylate, allyl methacrylate and divinyl benzene) can also be used as the polymeric dispersant.

These polymeric dispersants for use in the polymerization reaction is selected depending on the kind of hydrophilic organic liquid and the kind of seed used in the reaction. It also depends on whether the reaction is seed-manufacture reaction or seed-growing reaction. In order to prevent adherence between each of the resultant polymer particles, the polymeric dispersant having a high affinity and sorbability to the resultant polymer particle and a high affinity and solubility to the hydrophilic organic liquid, is preferably used. In addition, in order to improve stereoscopic repulsive force generated between each of the resultant polymer particles, the polymeric dispersant having a certain length of molecular chain and the molecular weight of not less than 10,000 is preferably used. However, when the molecular weight is too high, viscosity of the liquid is so high that the liquid cannot be uniformly agitated. Therefore, such a polymeric dispersant cannot uniformly separates out on each of the resultant polymer particles. The resultant polymer particles can be stably dispersed when the monomer used in manufacturing the polymeric dispersant is mixed with the monomer used in manufacturing the resultant polymer.

In combination with the polymeric dispersants, the following materials can be used to improve dispersion stability and particle diameter distribution of the resultant particulate polymer: fine powders (preferably having a particle diameter of not greater than 1 μm) of inorganic compounds such as metals (e.g., cobalt, iron, nickel, aluminum, copper, lead and magnesium) and their alloys and metal oxides (e.g., iron oxide, copper oxide, nickel oxide, zinc oxide, titanium oxide and silicon oxide); anionic surfactants such as alkylbenzene sulfonic acid salts, α-olefin sulfonic acid salts and phosphoric acid salts; cationic surfactants such as amine salts (e.g., alkyl amine salts, aminoalcohol fatty acid derivatives, polyamine fatty acid derivatives and imidadoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amine derivatives and polyhydric alcohol derivatives; and ampholytic surfactants such as alanine, amino acid (e.g., dodecyldi(aminoethyl)glycin and di(octylaminoethyl) glycin) and betaine.

In the seed-manufacture reaction, the hydrophilic organic liquid preferably includes the polymeric dispersant from 0.1 to 10% by weight, and more preferably from 1 to 5% by weight. It depends on the kind of the monomer used in the reaction. As the content of the polymeric dispersant increases, the particle diameter of the resultant toner gets smaller. However, when the content is greater than 10% by weight, the particle diameter of the resultant toner does not get smaller any more (i.e., saturated).

The vinyl monomer is soluble in the hydrophilic organic liquid. Specific examples of the vinyl monomers include styrenes such as o-methylstyrene, m-methylstyrene, p-methylstyrene, α-methylstyrene, p-ethylethylene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene and 3,4-dichlorostyrene; α-methyl fatty acid monocaboxylate such as methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, methyl methacrylate, ethyl methacrylate, propyl methacrylate, n-butyl methacrylate, isobutyl metacrylate, n-octyl methacrylate, dodecyl methacrylate, lauryl methacrylate, 2-ethylhexyl methacrylate, stearyl methacrylate, phenyl methacrylate, dimethylaminoethyl methacrylate and diethylaminoethyl methacrylate; derivatives of acrylic acid or methacrylic acid such as acrylonitrile, methacrylonitrile and acrylamide; halogenated vinyl compounds such as vinyl chloride, vinylidene chloride, vinyl bromide and vinyl fluoride. These vinyl monomers can be used alone or in combination. Furthermore, these vinyl monomers can be used in combination with a monomer capable of producing a copolymer thereof, provided that the content of the vinyl monomer is not less than 50% by weight.

The vinyl monomers can be polymerized in the presence of a crosslinking agent having plural reactive double bonds, in order to improve hot offset resistance of the resultant toner. Specific examples of the crosslinking agents include aromatic divinyl compounds such as divinylbenzene, divinylnapthtalene and their derivatives; diethylene carboxylates such as ethylene glycol dimethacrylate, diethylene glycol methacrylate, triethylene glycol methacrylate, trimethylolpropane triacrylate, allyl methacrylate, tert-butylaminoethyl methacrylate, tetraethylene glycol dimethacrylate and 1,3-butanediol dimethacrylate; divinyl compounds such as N,N-divinylaniline, divinylether, divinylsulfide and divinylsulfone; and coumpounds having three or more vinyl groups. These can be used alone or in combination.

When the crosslinking agent is used in the seed-manufacture reaction, inside of the resultant particulate polymer is crosslinked. In contrast, when the crosslinking agent is used in the seed-growth reaction, outside of the resultant particulate polymer is crosslinked.

In order to control the average molecular weight of the resultant particulate polymer, compounds having a large chain transfer constant can be used. Specific examples of the compounds having a large chain transfer constant include low-molecular-weight compounds having a mercapto group, carbon tetrachloride, carbon tetrabromide, etc.

Specific examples of polymerization initiators for use in the dispersion polymerization include azo initiators such as 2,2'-azobisisobutyronitrile and 2,2'-azobis(2,4-dimethylvaleronitrile); peroxide initiator such as lauryl peroxide, benzoyl peroxide and t-butyl peroxide; persulfate initiator such as potassium persulfate; and combinations of these initiators, and sodium thiosulfate or amine. The content of the polymerization initiator is preferably from 0.1 to 10 parts by weight per 100 parts by weight of the monomer.

The contents and the mixing ratio of the polymeric dispersant and the vinyl monomer included in the hydrophilic organic liquid is determined depending on the target particle diameter and target particle diameter distribution of the resultant particulate polymer. Typically, as the content of the polymeric dispersant increases, the particle diameter of the resultant particulate polymer gets smaller. On the other hand, as the content of the vinyl monomer increases, the particle diameter distribution of the resultant particulate polymer gets narrower.

In dispersion polymerization method, the toner is prepared by the following method.

At first, a polymeric dispersant is dissolved in a hydrophilic organic liquid. Then, a vinyl monomer or plural vinyl monomers and a polymerization initiator are added thereto, optionally together with an inorganic fine powder, a surfactant, a dye and a pigment. The mixture is agitated at a revolution of from 30 to 300 rpm, preferably as slow as possible, and preferably using a turbine-type agitator than a paddle-type agitator. The mixture is heated to a temperature corresponding to the polymerization speed of the polymerization initiator used, and then polymerization starts. The initial temperature of the polymerization largely effects on the resultant polymer. Therefore, it is preferable that the polymerization initiator is dissolved in a small amount of solvent so as to be added to the monomer mixture after start heating. In a reaction vessel, oxygen in the air must be purged and replaced with inert gases such as nitrogen gas and argon gas. When the oxygen purge is insufficient, particles smaller than the target size tend to be produced. Typically, the polymerization takes 5 to 40 hours, but the polymerization speed can be reduced by the following methods: stopping the polymerization when the target-size particles are obtained; adding the extra polymerization initiator; and performing the polymerization under the high pressure.

After the polymerization is finished, the mixture is subjected to dyeing process. Alternatively, the mixture can be subjected to washing process (such as settling separation, centrifugal separation and decantation) to remove undesired substances (such as small particles, residual monomers and the polymeric dispersant) and the thus prepared slurry can be subjected to dyeing process. It is preferable that the dyeing process is performed while the dispersants are included in the mixture because the resultant polymer particles do not aggregate and stably dyed thereby.

The dyeing process will be explained below. At first, the particulate polymer is dispersed in an organic solvent in which the particulate polymer is insoluble. A dye is dissolved in the organic solvent before or after the particulate polymer is dispersed therein. The dye penetrates into the particulate polymer. The dyed particulate polymer is prepared by removing the organic solvent from the mixture. The dye satisfies the following equation:

$$(D1)/(D2) \leqq 0.5$$

wherein D1 represents solubility of the dye in the organic solvent and D2 represents solubility of the dye in the polymer, at 25° C. Such a dye can deeply and efficiently penetrate into the particulate polymer. In this regard, "solubility of the dye in the polymer" means "the largest amount of the dye which can dissolve in the polymer". Whether the dye is dissolved or deposited in the polymer can be determined by directly observing the condition using a microscope. Alternatively, "solubility of the dye in an organic solvent in which the polymer is soluble (i.e., solubility coefficient of the organic solvent and the polymer is close)" can be used for "solubility of the dye in the polymer".

As mentioned above, (D1)/(D2) is preferably not greater than 0.5, and more preferably not greater than 0.2. Any dyes having such solubility characteristic can be used in the dyeing process. However, water-soluble dyes such as cationic dyes and anionic dyes deteriorate environmental resistance, electric resistance and transferability of the resultant toner. Therefore, vat dyes, disperse dyes and oil-soluble dyes are preferably used. Among these, oil-soluble dyes are most preferably used. These dyes can be used alone or in combination, according to the target color tone. The content of the dye used in the dyeing process is preferably 1 to 50 parts by weight per 1 part of the particulate polymer. When the organic solvent used is an alcohol having high SP value such as methanol and ethanol, and the particulate polymer used is a styrene-acrylate copolymer having SP value of 9, suitable dyes for use in the dying process include C.I. Solvent Yellow 6, 9, 17, 31, 35, 1, 102, 103 and 105; C.I. Solvent Orange 2, 7, 13, 14 and 66; C.I. Solvent Red 5, 16, 17, 18, 19, 22, 23, 143, 145, 146, 149, 150, 151, 157 and 158; C.I. Solvent Violet 31, 32, 33 and 37; C.I. Solvent Blue 22, 63, 78, 83, 84, 85, 86, 91, 94, 95 and 104; C.I. Solvent Green 24 and 25; and C.I. Solvent Brown 3 and 9.

Specific examples of the marketed products of the dyes include AIZEN SOT YELLOW 1, 3 and 4, ORANGE 1, 2 and 3, SCARLET 1, RED 1, 2 and 3, BROWN 2, BLUE 1 and 2, VIOLET 1, GREEN 1, 2 and 3, and BLACK 1, 4, 6 and 8 (from Hodogaya Chemical Co., Ltd.); SUDAN® YELLOW 140 and 150, ORANGE 220, RED 290, 380 and 460, and BLUE 670 (from BASF Aktiengesellschaft); DIARESIN® YELLOW 3G, F, H2G, HG, HC and HL, ORANGE HS and G, RED GG, S, HS, A, K and H5B, VIOLET D, BLUE J, G, N, K, P, H3G and 4G, GREEN C and BROWN A (from Mitsubishi Chemical Corporation); OIL COLOR YELLOW 3G, GG-S and #105, ORANGE PS, PR and #201, SCARLET #308, RED 5B, BROWN GR and #416, GREEN BG and #502, BLUE BOS and HN, and BLACK HBB, #803, EE and EX (from Orient Chemical Industries, Ltd.); SUMIPLAST® BLUE GP and OR, RED FB and 3B, and YELLOW FL, 7G and GC (from Sumitomo Chemical Co., Ltd.); KAYALON POLYESTER BLACK EX-SH3, KAYASET RED B and KAYASET BLUE A-2R (from Nippon Kayaku Co., Ltd.); etc, but are not limited thereto.

The difference of SP values (ΔSP) between the particulate polymer and the organic solvent for use in the dyeing process is preferably not less than 1.0, more preferably not less than 2.0, and much more preferably from 2 to 5. The particulate polymer is dissolved or swelled in such an organic solvent. When ΔSP is too large, the organic solvent is not wettable to the particulate polymer, resulting in deterioration of particle dispersability. In case a particulate styrene-acrylate copolymer is subjected to dyeing, suitable organic solvents having higher SP value include alcohols such as methanol, ethanol and n-propanol, and suitable organic solvents having lower SP value include n-hexane and n-heptane.

After the particulate polymer is dispersed in the organic solvent including a dye, it is preferable that the dispersion is kept at a temperature of not greater than glass transition temperature (Tg) of the particulate polymer, while being agitated. Thereby, the polymer particles do not aggregate. When the heating temperature is higher than Tg, each of the polymer particles fused. Known agitators such as HOMOMIXER and magnetic stirrer can be used as an agitator. Of course, slurry prepared by dispersion polymerization, i.e., dispersion in which a particulate polymer is dispersed in an organic solvent, can be directly mixed with the dye, followed by heating and agitating. The slurry can be dried under reduced pressure after or without being subjected to filtration. When the slurry is dried after being subjected to filtration, most of the resultant polymer particles do not aggregate, i.e., the particle diameter distribution of the particulate polymer is kept.

Dissolution Suspension Method

Next, dissolution suspension method is explained in detail. In dissolution suspension method, a particulate resin is prepared as follows:

(1) dissolving a resin in an organic solvent to prepare a resin solution;

(2) emulsifying the resin solution into an aqueous medium to prepare a resin emulsion; and (3) removing the organic solvent from the resin emulsion to prepare a particulate resin dispersion.

Suitable aqueous media include water. In addition, other solvents which can be mixed with water can be added to water. Specific examples of such solvents include alcohols such as methanol, isopropanol and ethylene glycol; dimethylformamide, tetrahydrofuran, cellosolves such as methyl cellosolve, lower ketones such as acetone and methyl ethyl ketone, etc.

Specific examples of the resins include polymers of styrene and its substitution products such as polystyrene, poly-p-chlorostyrene and polyvinyltoluene; copolymers of styrenes such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloro methyl methacrylate copolymer, styrene-acrylonitrile-copolymer, styrene-vinyl methyl ketone copolymer, styrene-butadiene copolymer, styrene-isoprene copolymer, styrene-acrylonitrile-indene copolymer, styrene-maleic acid copolymer and styrene-malaete copolymer; polymethylmethacrylate, polybutylmethacrylate, polyvinylchloride, polyvinyl acetate, polyethylene, polypropylene, polyester, epoxy resin, epoxy polyol resin, polyurethane, polyamide, polyvinylbutyral, polyacrilic acid resin, rosin, modified rosin, terpene resin, aliphatic or alicyclic hydrocarbon resin, aromatic petroleum resin, halogenated paraffin, paraffin wax, etc. These can be used alone or in combination.

Suitable organic solvents include volatile solvents having a boiling point of lower than 100° C. so as to be easily removed after the granulating process. Specific examples of the volatile solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobuthyl ketone. These solvents can be used alone or in combination. In particular, aromatic solvents such as toluene and xylene, and halogenated hydrocarbons such as metylene chloride, 1,2-dichloroethane, chloroform and carbon tetrachloride are preferably used. The added amount of the organic solvent is generally from 10 to 900 parts per 100 parts by weight of the toner constituent mixture.

Other toner constituents such as a colorant (or a master batch colorant), a release agent, a charge controlling agent, etc. can be directly added to the aqueous medium together with the resin solution, but it is preferable that the toner constituents are previously added to the resin solution. Further, other toner constituents can be added to the emulsion or dispersion after the particles are formed. Specifically, colorless particles prepared by the above-mentioned methods can be colored by a known dyeing method.

As the dispersing machine, known mixers and dispersing machines such as low shearing type dispersing machines, high shearing type dispersing machines, friction type dispersing machines, high pressure jet type dispersing machines and ultrasonic dispersing machine can be used. Preferably, homogenizers and high pressure homogenizers, which have a high speed rotor and a stator; and dispersing machines using media such as ball mills, bead mills and sand mills can be used.

In order to prepare a dispersion including particles having an average particle diameter of from 2 to 20 μm, high shearing type dispersing machines such as emulsifiers having a rotating blade are preferably used. Specific examples of the marketed dispersing machines of this type include continuous dispersing machines such as ULTRA-TURRAX® (from IKA Japan) POLYTRON® (from KINEMATICA AG), TK AUTO HOMO MIXER® (from Tokushu Kika Kogyo Co., Ltd.), EBARA MILDER® (from Ebara Corporation), TK PIPE-LINE HOMO MIXER® (from Tokushu Kika Kogyo Co., Ltd.), TK HOMOMIC LINE FLOW® (from Tokushu Kika Kogyo Co., Ltd.), colloid mill (from SHINKO PANTEC CO., LTD.), slasher, trigonal wet pulverizer (from Mitsui Miike Machinery Co., Ltd.), CAVITRON® (from Eurotec), and FINE FLOW MILL® (from Pacific Machinery & Engineering Co., Ltd.); and batch type emulsifiers or batch/continuous emulsifiers such as CLEARMIX® (from M Technique) and FILMICS (from Tokushu Kika Kogyo Co., Ltd.).

When high shearing type dispersing machines are used, the rotation speed of rotors is not particularly limited, but the rotation speed is generally from 1,000 to 30,000 rpm and preferably from 5,000 to 20,000 rpm. In addition, the dispersing time is also not particularly limited, but the dispersing time is generally from 0.1 to 5 minutes. The temperature in the dispersing process is generally 0 to 150° C. (under pressure), and preferably from 10 to 98° C. The processing temperature is preferably as high as possible because the viscosity of the dispersion decreases and thereby the dispersing operation can be easily performed.

In order to prepare a stable dispersant, the aqueous medium can include a solid particulate dispersant. Further, in order to control sorbabilty of the solid particulate dispersant to droplets, the aqueous medium can include another surfactants. These surfactants can be added before the resin solution is emulsified, or when the solvent is removed.

Suitable particulate solid dispersants for use in the method for preparing the toner of the present invention include particulate materials which hardly soluble in water and which have an average particle diameter of from 0.01 to 1 μm.

Specific examples of such materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, tricalcium phosphate, calcium carbonate, colloidal titanium oxide, colloidal silica, and hydroxyapatite etc.

Among the materials, tricalcium phosphate, calcium carbonate, colloidal titanium oxide, colloidal silica, and hydroxyapatite can be preferably used. Particularly, hydroxyapatite which is synthesized by reacting sodium phosphate with calcium chloride under alkaline conditions is more preferable.

In addition, particles of low molecular weight organic compounds; and polymers such as polystyrene, polymethacrylates, and polyacrylate copolymers, which are prepared by a polymerization method such as soap-free emulsion polymerization methods, suspension polymerization methods and dispersion polymerization methods; particles of a polymer such as silicone, benzoguanamine and nylon, which are prepared by a polymerization method such as polycondensation methods; and particles of a thermosetting resin, can also be used as the solid dispersant for use in the toner of the present invention.

When compounds soluble to both acids and bases, such as calcium phosphate salts, are used as a particulate solid dispersant, it is preferable that the particulate solid dispersant is dissolved by acids such as hydrochloric acid or bases such as sodium hydroxide, followed by washing with water. Enzymes are also usable to remove the dispersant.

Specific examples of another dispersants include anionic surfactants such as alkylbenzene sulfonic acid salts, α-olefin sulfonic acid salts and phosphoric acid salts; cationic surfactants such as amine salts (e.g., alkyl amine salts, aminoalcohol fatty acid derivatives, polyamine fatty acid derivatives and imidadoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amine derivatives, polyhydric alcohol derivatives; and ampholytic surfactants such as aniline, dodecyldi(aminoethyl)glycin, di(octylaminoethyl)glycin, and N-alkyl-N,N-dimethylammonium betaine.

By using a fluorine-containing surfactant as the surfactant, good charging properties and good charge rising property can be imparted to the resultant toner. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{ω-fluoroalkyl(C6-C11)oxy}-1-alkyl (C3-C4) sulfonate, sodium 3-{ω-fluoroalkanoyl (C6-C8)-N-ethylamino}-1-propanesulfonate, fluoroalkyl(C11-C20) carboxylic acids and their metal salts, perfluoroalkyl(C7-C13) carboxylic acids and their metal salts, perfluoroalkyl (C4-C12) sulfonate and their metal salts, perfluorooctanesulfonic acid diethanol amides, N-propyl-N-(2-hydroxyethyl)perfluorooctanesulfone amide, perfluoroalkyl (C6-C10)sulfoneamidepropyltrimethyl ammonium salts, salts of perfluoroalkyl(C6-C10)-N-ethylsulfonyl glycin, monoperfluoroalkyl(C6-C16)ethylphosphates, etc.

Specific examples of the marketed products of such surfactants include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 123B, 306A, 501, 201 and 204, which are manufactured by Tochem Products Co., Ltd.; FUTARGENT® F-100 and F-150 manufactured by Neos; etc.

Specific examples of the cationic surfactants having a fluoroalkyl group include primary, secondary and tertiary aliphatic amines having a fluoroalkyl group, aliphatic quaternary salts such as perfluoroalkyl(C6-C10) sulfoneamidepropyltrimethylammonium salts, benzalkonium salts, benzetonium chloride, pyridinium salts, imidazolinium salts, etc.

Specific examples of the marketed products thereof include SARFRON® S-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Further, it is possible to stably disperse the toner constituent mixture liquid in an aqueous liquid using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine) In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

These dispersants can remain on the surface of the toner, but it is preferable to remove the dispersant remaining on the surface of the resultant toner particulate to improve the chargability.

In order to remove an organic solvent from the emulsion, a method in which the emulsion is gradually heated to perfectly evaporate the organic solvent in the drops of the oil phase can be used. Alternatively, a method in which the emulsion is sprayed in a dry environment to dry the organic solvent in the drops of the oil phase and water in the dispersion, resulting in formation of toner particles, can be used. Specific examples of the dry environment include gases of air, nitrogen, carbon dioxide, combustion gas, etc., which are preferably heated to a temperature not lower than the boiling point of the solvent having the highest boiling point among the solvents used in the emulsion. Toner particles having desired properties can be rapidly prepared by performing this treatment using a spray dryer, a belt dryer, a rotary kiln, etc.

In dispersion suspension method, the solid particulate dispersant adheres to the surface of the oil droplet so that the oil droplet can be stably dispersed in spherical shape. As the organic solvent is removed from the oil droplet, the volume of the droplet decreases while the solid particulate dispersant remaining on the surface of the droplet. Therefore, decrease speed of the surface area of the droplet cannot follow that of the volume of the droplet, resulting in producing a non-spherical toner.

For this reason, in order to produce a highly spherical toner, adsorbability of the solid particulate dispersant to the oil droplet must be weaken when the organic solvent is removed from the oil droplet. Thereby, the solid particulate dispersant can easily desorb from the oil droplet, resulting in producing a spherical toner. To weaken the adsorbability of the solid particulate dispersant, the following methods are preferably used: adding a surfactant or a polymeric protection colloid so that these can exchange-adsorb to the oil droplet; and changing charges of the oil droplet and the solid particulate dispersant by controlling pH of the aqueous medium.

Pulverized Toner Treatment

A pulverized toner has an irregular shape, and typically has the average circularity of from 0.93 to 0.95. Such a pulverized toner having an irregular shape can alter the shape into a nearly spherical form by applying below-mentioned mechanical or thermal treatments thereto. The resultant toner has the average circularity of from 0.96 to 1.00.

[Mechanical Treatment]

A pulverized toner can alter the shape into spherical form by continuously applying mechanical stress using machines such as TURBO MILL (from Turbo Kogyo Co., Ltd.) disclosed in JP-A 09-085741, KRYPTRON (from Kawasaki Heavy Industries, Ltd.), Q-TYPE MIXER (from Mitsui Mining Co., Ltd.), HYBRIDIZER (from Nara Machinery Co., Ltd.) and MECHANOFUSION® (from Hosokawa Micron Corporation).

[Dry Thermal Treatment]

A pulverized toner can alter the shape into spherical form by applying a hot-air having a temperature of from 100 to 300° C., to semi-melt the surface of the toner, using machines such as SURFUSING SYSTEM (from Nippon Pneumatic Mfg. Co., Ltd.).

[Wet Thermal Treatment]

A pulverized toner can alter the shape into spherical form by dipping into a high-temperature liquid having a temperature in which the toner become plastic (about 200° C.).

<Charge Controlling Agent>

Any known charge controlling agents can be used for the toner of the present invention to control the charge properties of the toner. Specific examples of the charge controlling agent include Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc.

Specific examples of the marketed products of the charge controlling agents include BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by orient Chemical Industries Co., Ltd. TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

When a toner is manufactured in an aqueous medium, charge controlling agent, which is hardly soluble in the water, is preferably used from the viewpoints of controllability of ionic strength and wastewater pollution.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity, and thereby the electrostatic force of a developing roller attracting the toner increases, resulting in deterioration of the fluidity of the toner and image density of the toner images.

<Colorant>

Suitable materials for use as the colorant include known dyes and pigments. Specific examples of the dyes and pigments include carbon black, Nigrosine dyes, black iron oxide, Naphthol Yellow S (C.I. 10316), Hansa Yellow 10G (C.I. 11710), Hansa Yellow 5G (C.I. 11660), Hansa Yellow G (C.I. 11680), Cadmium Yellow, yellow iron oxide, loess, chrome yellow, Titan Yellow, polyazo yellow, Oil Yellow, Hansa Yellow GR (C.I. 11730), Hansa Yellow A (C.I. 11735), Hansa Yellow RN (C.I. 11740), Hansa Yellow R (C.I. 12710), Pigment Yellow L (C.I. 12720), Benzidine Yellow G (C.I. 21095), Benzidine Yellow GR (C.I. 21100), Permanent Yellow NCG (C.I. 20040), Vulcan Fast Yellow 5G (C.I. 21220), Vulcan Fast Yellow R (C.I. 21135), Tartrazine Lake, Quinoline Yellow Lake, Anthrazane Yellow BGL (C.I. 60520), isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red F2R (C.I. 12310), Permanent Red F4R (C.I. 12335), Permanent Red FRL (C.I. 12440), Permanent Red FRLL (C.I. 12460), Permanent Red F4RH (C.I. 12420), Fast Scarlet VD, Vulcan Fast Rubine B (C.I. 12320), Brilliant Scarlet G, Lithol Rubine GX (C.I. 12825), Permanent Red F5R, Brilliant Carmine 6B, Pigment Scarlet 3B, Bordeaux 5B, Toluidine Maroon, Permanent Bordeaux F2K (C.I. 12170), Helio Bordeaux BL (C.I. 14830), Bordeaux 10B, Bon Maroon Light (C.I. 15825), Bon Maroon Medium (C.I. 15880), Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue RS (C.I. 69800), Indanthrene Blue BC (C.I. 69825), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 0.1 to 50 parts by weight per 100 parts by weight of the binder resin.

Master batches, which are complexes of a colorant with a resin, can be used as the colorant of the toner of the present invention. Specific examples of the resins for use as the binder resin of the master batches include styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

<Release Agent>

The toner of the present invention can include a wax as a release agent in combination with a binder resin and a colorant. Specific examples of the waxes include paraffin waxes, micro waxes, rice waxes, aliphatic amide waxes, fatty acid waxes, aliphatic monoketone waxes, fatty acid metal salt waxes, fatty ester waxes, partially-saponified fatty ester waxes, silicone varnishes, fatty alcohols, carnauba waxes, polyolefines such as low-molecular-weight polyethylene and polypropylene, etc. The melting point of the waxes for use in the toner of the present invention is from 40 to 120° C., and preferably from 50 to 110° C. When the melting point is too high, low-temperature fixability of the resultant toner deteriorates. In contrast, when the melting point is too low, hot offset resistance and durability of the resultant toner deteriorate. The melting point of the waxes can be determined using DSC (differential scanning calorimetry) The melting point is defined as a melting peak which is observed when a few milligrams of the sample is heated at a predetermined speed (for example, 10° C./min).

<External Additive>

The mother toner particles can be mixed with an external additive (e.g., hydrophobized silica and titanium oxide) using a mixer to improve fluidity, developing properties and transferring properties of the toner particles. Suitable mixers for use in mixing the mother toner particles and an external additive include known mixers for mixing powders, which preferably have a jacket to control the inside temperature thereof. By changing the timing when the external additive is added or the addition speed of the external additive, the stress on the external additive (i.e., the adhesion state of the external additive with the mother toner particles) can be changed. Of course, by changing rotating number of the blade of the mixer used, mixing time, mixing temperature, etc., the stress can also be changed. In addition, a mixing method in which at first a relatively high stress is applied and then a relatively low stress is applied to the external additive, or vice versa, can also be used.

Specific examples of the mixers include V-form mixers, locking mixers, Loedge Mixers, Nauter Mixers, Henschel Mixers and the like mixers.

Inorganic fine particles are typically used as the external additive. Inorganic particulate materials having a primary particle diameter of from 0.01 to 2 μm are preferably used. The surface area of the inorganic particulate materials is preferably from 20 to 500 $m^2/g$ when measured by a BET method. The content of the inorganic particulate material is preferably from 0.1% to 15% by weight, and more preferably from 0.5% to 10% by weight, based on the total weight of the toner. Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Particles of a polymer such as polystyrene, polymethacrylates, and polyacrylate copolymers, which are prepared by a polymerization method such as soap-free emulsion polymerization methods, suspension polymerization methods and dispersion polymerization methods; particles of a polymer such as silicone, benzoguanamine and nylon, which are prepared by a polymerization method such as polycondensation methods; and particles of a thermosetting resin can also be used as the external additive of the toner of the present invention. By using these particulate polymers in combination with the inorganic particulate material, chargability of the resultant toner improves, resulting in decreasing the occurrence of background development. The content of the particulate polymer is preferably from 0.01% to 5% by weight, and more preferably from 0.1% to 2% by weight, based on the total weight of the toner.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Mother Toner Particles (A) by Suspension Polymerization Method

In a 500 ml four-separable flask equipped with a stirrer, a condenser, a gas feed pipe and a thermometer, 40 parts of a styrene monomer, 20 parts of a carbon black (MA100 from Mitsubishi Chemical Corporation) and 0.5 parts of a polymerization initiator (2,2'-azobisisobutyronitrile) were contained and the mixture was agitated with the stirrer for 30 minutes at room temperature under nitrogen gas stream. The air in the flask was replaced with nitrogen gas. Then the mixture was agitated for 6 hours at a revolution of 60 rpm at 70° C. in a hot-water bath. Thus, a graft carbon black was prepared.

A mixture of the following components was subjected to a dispersion treatment using a ball mill for 10 hours.

| | |
|---|---|
| Styrene monomer | 50.0 parts |
| n-Butyl methacrylate | 14.5 parts |
| 1,3-Butanediol dimethacrylate | 0.5 parts |
| t-Butylacrylamide sulfonic acid | 3.0 parts |
| Low-molecular-weight polyethylene (MITSUI HI-WAX 210P from Mitsui Chemicals, Inc.) | 2.0 parts |
| Graft carbon black (prepared above) | 30.0 parts |

Then 1 part of a 2,2'-azobisisobutyronitrile and 1 part of a sodium nitrite were added to the mixture. Further, 250 parts of a 25% aqueous solution of a polyvinyl alcohol was added thereto, and the mixture was agitated for 10 minutes at a revolution of 6000 rpm using TK HOMOMIXER (from Tokushu Kika Kogyo Co., Ltd.). Thus, a suspension was prepared.

The suspension was fed in a 500 ml four-separable flask equipped with a stirrer, a condenser, a gas feed pipe and a thermometer, and agitated with the stirrer for 30 minutes at room temperature under nitrogen gas stream. The oxygen in the flask was replaced with nitrogen gas. Then the suspension was agitated for 8 hours at a revolution of 90 rpm at 70° C. in a hot-water bath to perform the polymerization. Thus, a particulate polymer was prepared by suspension polymerization.

100 parts of the particulate polymer was re-dispersed in a water/methanol mixture (mixing ratio of 1/1 by weight) at 30% on a solid basis. Then 3 parts of a charge controlling agent (zinc di-t-butyl salicylate) was added thereto and agitated, followed by washing and drying. Thus, mother toner particles (A) were prepared.

The mother toner particles (A) have an average circularity of 0.98 and a weight average particle diameter of 5.81 μm.

Preparation of Mother Toner Particles (B) by Pulverization Method

The following components were mixed using HENSHEL MIXER.

| | |
|---|---|
| Binder resin (Styrene-methyl acrylate copolymer) | 100.0 parts |
| Colorant (MITSUBISHI ® CARBON BLACK #44 from Mitsubishi Chemical Corporation) | 10.0 parts |
| Charge controlling agent (Zinc di-t-butyl salicylate, BONTRON E-84 from Orient Chemical Industries, Inc.) | 2.0 parts |
| Carnauba wax | 5.0 parts |

The mixture was kneaded with a compact two-roll mill for 2 hours at 150° C., followed by coarse pulverization with a pulverizer having 2 mm-screen and fine pulverization with a laboratory jet mill. Then the pulverized particles were classified using 100MZR. Thus, mother toner particles (B) were prepared.

The mother toner particles (B) have an average circularity of 0.93 and a weight average particle diameter of 5.73 μm.

Preparation of Mother Toner Particles (C) by Pulverization Method and Thermal Treatment The procedure for preparation of the mother toner particles (B) was repeated. The thus prepared mother toner particles were subjected to a thermal treatment using SURFUSING SYSTEM (from Nippon Pneumatic Mfg. Co., Ltd.) twice. The treatment conditions were as follows.

Treatment temperature: 250° C.

Volume of hot-air: 1000 l/min

Volume of feed air: 100 l/min

Thus, mother toner particles (C) were prepared. The mother toner particles (C) have an average circularity of 0.97 and a weight average particle diameter of 5.56 μm.

The properties of each of the thus prepared mother toner particles are shown in Table 1.

TABLE 1

| Mother toner | (A) | (B) | (C) |
|---|---|---|---|
| Manufacturing method | Suspension polymerization | Pulverization | Pulverization and Thermal treatment |
| Average circularity | 0.98 | 0.93 | 0.97 |
| Dv (μm) | 5.81 | 5.73 | 5.56 |

Example 1

One hundred (100) parts of the mother toner particles (B) were mixed with 2.4 parts of a silica and 0.8 parts of a titanium oxide using HENSHEL MIXER for 2 minutes, followed by sieving. Thus, a toner (1) was prepared.

One hundred (100) parts of the mother toner particles (B) were mixed with 2.0 parts of a silica and 0.8 parts of a titanium oxide using HENSHEL MIXER for 2 minutes, followed by sieving. Thus, a toner (2) was prepared.

One hundred (100) parts of the mother toner particles (B) were mixed with 1.6 parts of a silica and 0.8 parts of a titanium oxide using HENSHEL MIXER for 2 minutes, followed by sieving. Thus, a toner (3) was prepared.

One hundred (100) parts of the mother toner particles (B) were mixed with 1.2 parts of a silica and 0.8 parts of a titanium oxide using HENSHEL MIXER for 2 minutes, followed by sieving. Thus, a toner (4) was prepared.

Toners (1), (2), (3) and (4) were respectively set in the developing device 4. After 30 minutes of continuous running of the developing device 4, a surface potential of a toner layer was measured by a surface potential electrometer to determine $t_g$. And then the developing device 4 was set to the image forming apparatus 100 to produce images. The produced images were visually observed to evaluate the image quality. The developing roller 402 took 0.35 seconds per one rotation. The results are shown in Table 2.

TABLE 2

| Toner | (1) | (2) | (3) | (4) |
|---|---|---|---|---|
| External additives[1)] | Si 2.4 parts Ti 0.8 parts | Si 2.0 parts Ti 0.8 parts | Si 1.6 parts Ti 0.8 parts | Si 1.2 parts Ti 0.8 parts |
| $t_g$ | 0.25 | 0.35 | 0.5 | 1.05 |
| Image quality | Very good | Good | Acceptable | Acceptable |

External additives[1)]: "Si" means silica and "Ti" means titanium oxide.

Example 2

Toners (1) and (2) were respectively set in the developing device 4. An initial surface potential of a toner layer and a surface potential of a toner layer after 30 minutes of continuous running of the developing device 4 were measured by a surface potential electrometer to determine initial $t_g$ ($t_g1$) and $t_g$ after 30-minutes running ($t_g2$), i.e., $t_g2$ is equal to $t_g$ measured in Example 1. A fresh toner was set in the developing device 4. Then the developing device 4 was set to the image forming apparatus 100, and a running test in which 1,000 printings are produced were performed while a fresh toner was supplied every 5 minutes. The image produced after the running test was visually observed to determine whether the image has background fouling. The charge quantity distribution of the toner remaining on the developing roller 402 was measured by E-SPART ANALYZER (manufactured by Hosokawa Micron Corporation) to determine the amount of deteriorated toner particles. The deteriorated toner includes reversely charged toner, weakly charged toner and positively charged toner. The results are shown in Table 3.

TABLE 3

| Toner | (1) | (2) |
|---|---|---|
| $t_g1$ | 0.11 | 0.08 |
| $t_g2$ | 0.25 | 0.35 |
| $t_g2/t_g1$ | 2.273 | 4.375 |
| Amount of deteriorated toner | 5% | 15% |
| Image quality | Very good | Bad |

It is clear from Table 3 that when $t_g2/t_g1$ is smaller than 4, the amount of deteriorated toner decreases, resulting in producing high quality images.

Example 3

One hundred (100) parts of the mother toner particles (B) were mixed with 3 parts of a silica and 2 parts of a titanium oxide using HENSHEL MIXER for 2 minutes, followed by sieving. Thus, a toner (5) was prepared.

One hundred (100) parts of the mother toner particles (C) were mixed with 3 parts of a silica and 2 parts of a titanium oxide using HENSHEL MIXER for 2 minutes, followed by sieving. Thus, a toner (6) was prepared.

The toners (5) and (6) were respectively set in the developing device 4. The surface potential of the toner layer was measured using a surface potential electrometer to determine $t_g$ at 0, 5, 10, 15 and 30 minutes after continuous running of the developing device 4. The results are shown in FIG. 5.

Figure 5:
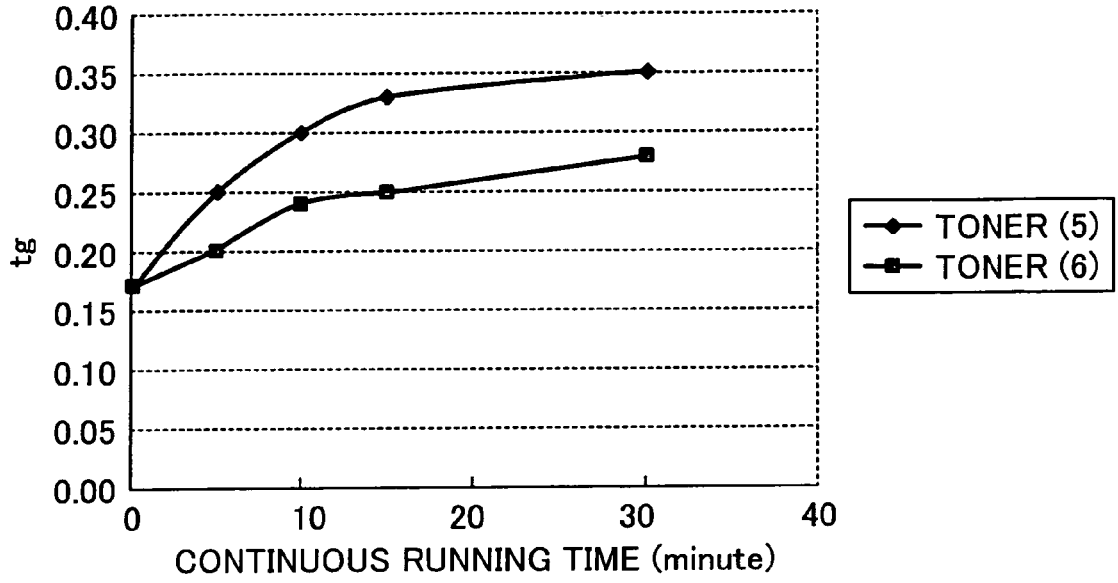
FIG. 5 is a graph illustrating the relationship between the continuous running time of the developing device and the time constant $t_g$ of the toner.

It is clear from FIG. 5 that amount of the change in $t_g$ of toner (6) having spherical shape is smaller than that of toner (5) having irregular shape.

Example 4

One hundred (100) parts of the mother toner particles (B) were mixed with 3 parts of a silica having a particle diameter of 20 nm and 2 parts of a titanium oxide using HENSHEL MIXER for 2 minutes, followed by sieving. Thus, a toner (7) was prepared.

One hundred (100) parts of the mother toner particles (C) were mixed with 3 parts of a silica having a particle diameter of 60 nm and 2 parts of a titanium oxide using HENSHEL MIXER for 2 minutes, followed by sieving. Thus, a toner (8) was prepared.

The toners (7) and (8) were respectively set in the developing device 4. A running test in which 40,000 printings were continuously produced was performed. The amount of the toner existing on the developing roller 402 was measured after 0, 10,000, 20,000, 30,000 and 40,000 printings were produced. The results are shown in FIG. 6.

Figure 6:
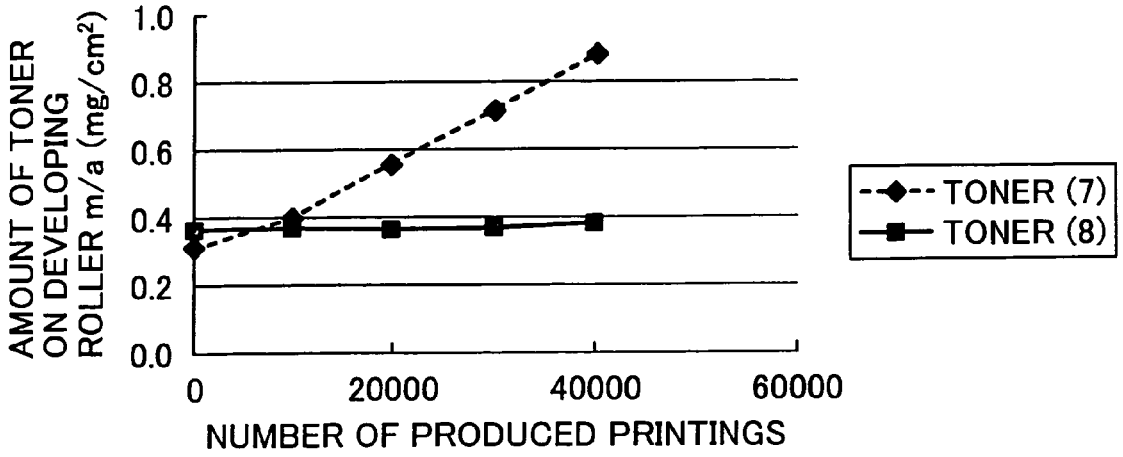
FIG. 6 is a graph illustrating the relationship between the number of produced printings and the amount of toner on the developing roller.

It is clear from FIG. 6 that the amount of the toner existing on the developing roller 402 is stable when the toner (8), having spherical shape and a large-size external additive, was used.

Example 5

A running test in which 60,000 printings were continuously produced was performed using an image forming apparatus including the process cartridge 40 (hereinafter referred to as an image forming apparatus 200), and an image forming apparatus having same structure as image forming apparatus 200 except not including a toner removing device (hereinafter referred to as an image forming apparatus 300), respectively. Produced image quality was evaluated after 0, 10,000, 20,000, 30,000, 40,000, 50,000 and 60,000 printings were produced. The results are shown in FIG. 7.

Figure 7:
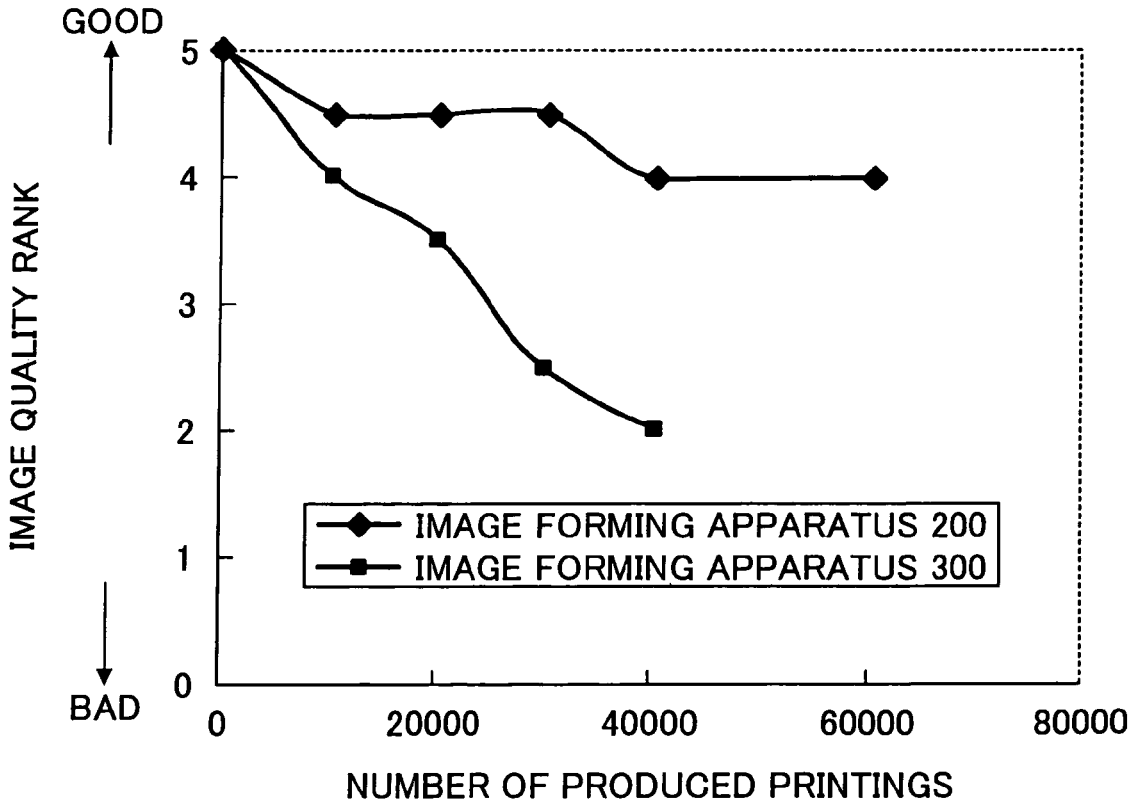
FIG. 7 is a graph illustrating the relationship between the number of produced printings and image quality rank of the produced images.

It is clear from FIG. 7 that the image forming apparatus 200 can stably produce high quality images. It is because the process cartridge has the toner removing device.

This document claims priority and contains subject matter related to Japanese Patent Application No. 2005-058582, filed on Mar. 3, 2005, the entire contents of each of which are incorporated herein by reference.

Having now fully described the invention, it will be apparent to one of ordinary skill in the art that many changes and modifications can be made thereto without departing from the spirit and scope of the invention as set forth therein.

The invention claimed is:

1. A developing device for developing an electrostatic latent image formed on an image bearing member, comprising:

a rotating developing roller bearing toner thereon, capable of developing the electrostatic latent image with the toner;

a toner layer forming member configured to form a toner layer on the developing roller, and charge the toner of the toner layer at a nip between the developing roller and the toner layer forming member; and a toner supplying device configured to supply fresh toner to the developing device, wherein a charge quantity (q) of the toner on the developing roller varies according to the following equation:

$$q(t)=A\cdot\{1-\exp(-t/t_g)\} \quad (1)$$

wherein t represents a nip passing time of the toner on the developing roller, $t_g$ represents a time constant of charging the toner, and A represents a constant, and wherein the time constant $t_g$ is smaller than a rotation time of the developing roller per rotation.

2. The developing device according to claim 1, wherein the time constant $t_g$ of the toner on the developing roller is less than 4 times $t_g$ of the supplied fresh toner.

3. The developing device according to claim 1, wherein the toner has an average circularity of from 0.96 to 1.00.

4. The developing device according to claim 1, wherein the toner has a volume average particle diameter of from 4 to 10 μm, and comprises an external additive having a volume average particle diameter of from 50 to 150 nm.

5. The developing device according to claim 1, further comprising a toner removing device configured to remove not less than 80% of the toner remaining on the developing roller after the toner passes the nip.

6. The developing device according to claim 1, further comprising:

an agitator configured to agitate the fresh toner supplied by the toner supplying device; and a feeding roller configured to feed the toner from the agitator to the developing roller, wherein the feeding roller rotates in the same direction as the developing roller.

7. An image forming apparatus comprising:

an image bearing member configured to bear an electrostatic latent image;

an electrostatic image forming device configured to form the electrostatic latent image on the image bearing member; and a developing device configured to develop the electrostatic latent image with a toner to form a visible image on the image bearing member, wherein the developing device is the developing device according to claim 1.

8. A process cartridge comprising:

an image bearing member configured to bear an electrostatic latent image; and the developing device according to claim 1.

9. A method for developing an electrostatic latent image, comprising:

charging an image bearing member;

forming an electrostatic latent image on the charged image bearing member; and developing the electrostatic latent image with a toner to form a visible image on the image bearing member using the developing device according to claim 1.

* * * * *